US005120225A

United States Patent [19]

Amit

[11] Patent Number: 5,120,225

[45] Date of Patent: Jun. 9, 1992

[54] METHOD AND APPARATUS FOR BRUSHING TEETH WITH CYCLICALLY ROTATING BRUSH STROKES

[76] Inventor: Noah Amit, c/o Iroquois, 49 W. 44th St., New York, N.Y. 10036

[21] Appl. No.: 694,468

[22] Filed: May 1, 1991

[51] Int. Cl.[5] ..... A46B 13/08; A61C 17/32

[52] U.S. Cl. ..... 433/216; 15/22.1; 15/167.1

[58] Field of Search ..... 15/22.1, 22.2, 22.4, 15/167.1, 167.2, 28; 433/216; 134/6

[56] References Cited

U.S. PATENT DOCUMENTS 4,010,506 3/1977 Young et al. ..... 15/22.1

4,545,087 10/1985 Nahum ..... 15/22.1

5,068,939 12/1991 Holland ..... 15/22.1

FOREIGN PATENT DOCUMENTS 0910591 6/1946 France ..... 15/22.1

*Primary Examiner*—Edward L. Roberts

*Attorney, Agent, or Firm*—Epstein, Edell & Retzer

[57] ABSTRACT

A toothbrush includes a cluster of rotatable bristle tufts disposed between two longitudinally spaced clusters of positionally fixed bristle tufts. The fixed bristles frictionally engage tooth surfaces to oppose longitudinal movement of the brush head in response to longitudinal reciprocation of the brush handle within the head. A rack and pinion convert the longitudinal reciprocation of the handle to oscillatory rotation of the rotatable bristle tufts.

16 Claims, 1 Drawing Sheet

METHOD AND APPARATUS FOR BRUSHING TEETH WITH CYCLICALLY ROTATING BRUSH STROKES

BACKGROUND OF THE INVENTION

1. Technical Field:

The present invention relates to improvements in methods and apparatus for brushing teeth and, more particularly, to toothbrushes having bristles that rotate relative to the brush head in response to linear reciprocation of the brush handle.

2. Discussion of the Prior Art:

It has long been recognized to be advantageous to apply a rotary brushing action to teeth to remove deposits that build-up on tooth surfaces, particularly adjacent the gum line. The desired brush rotation is about an axis perpendicular to the tooth surface and, for the usual toothbrush configuration, is approximately perpendicular to the brush handle. Hand manipulation of a conventional toothbrush to effect this desirable rotary brushing action is difficult at best, particularly in view of the small surface area to be cleaned and the resulting small radius of curvature of movements of the hand required to accomplish the necessary brush strokes. Powered toothbrushes have been employed to accomplish the desirable rotary brush action but have not achieved significant commercial success, primarily because of the reluctance by consumers to place a powered implement in their mouths. Examples of such powered toothbrushes for effecting rotary brush action of the type described are found in U.S. Pat. Nos. 1,265,536 (Sharps), 1,947,324 (Zerbee) and 4,274,173 (Cohen).

In point of fact, consumers are most comfortable with nonpowered toothbrushes requiring longitudinal reciprocation of the handle to effect brushing. The present invention is concerned with providing an efficient and inexpensive non-powered (i.e., operated solely in response to movement of the user's hand) technique for converting longitudinal brush handle reciprocation to the desired cyclical rotational brush strokes. In this regard, there have been a number of commercially unsuccessful attempts to accomplish this desirable result. For example, in U.S. Pat. No. 1,557,244 (Domingue), there is disclosed a plurality of brush elements mounted in a brush head by means of toothed pinons that are caused to rotate by longitudinal reciprocation of a rack secured to the brush handle and extending into the brush head. However, in order to use this brush, the brush head must be held stationary with one hand while the handle is reciprocated. Such two-handed operation has not achieved acceptance among consumers, most likely because of the difficulty involved in holding the brush head stationary while cleaning teeth located in the back and sides of the mouth.

In U.S. Pat. No. 1,620,330 (Douglass), plural brush sections, each symmetrically disposed about respective axes, are mounted on the brush head to be freely rotatable about those axes relative to the head. However, there is no mechanism provided for positively rotating the brushes in response to longitudinal reciprocation of the brush handle. In fact, true longitudinal movement of the brush handle creates purely radial, as opposed to tangential, not forces on the rotatable brush sections so that there is no turning force applied thereto. Accordingly, in the absence of some mechanism for positively converting the longitudinal forces to rotational forces, there is negligible rotation of the symmetrically mounted brush sections.

In U.S. Pat. No. 1,212,001 (Baxter) there is disclosed a toothbrush having plural brush sections mounted eccentrically on the brush head for pivotability, between stops, about respective axes. Once again, there is no positive mechanism for rotating the brush sections; rather, the frictional engagement between the ends of the bristles and the surfaces of the teeth provides the force that effects pivoting of the brush sections during the initial portion of each linear stroke of the brush handle. While that pivoting action is taking place, the bristle ends flex but move very little, if at all, across the teeth. It is only after the brush sections reach the pivot stops that the bristles move across the teeth, and such movement is linear, in the direction of handle movement, not rotational. Thus, although the brush sections pivot with each change in handle direction, the bristles do not apply the desired rotary brush strokes to the teeth.

There are other prior art toothbrushes wherein longitudinal movement of the brush handle is intended to be converted into some other degree of motion in the brush itself. For example, U.S. Pat. No. 2,660,745 (Yusko) discloses a toothbrush wherein the entire brush head oscillates about the longitudinal axis of the handle in response to longitudinal reciprocation of the handle. The result is an up and down movement of the brush bristles across the surfaces of the teeth. This brushing action was, at one time, considered to be efficient but in recent years has fallen into disfavor among dental professionals.

Still other toothbrushes having bristles that are movable in relation to the handle or head are found in the following U.S. Patents.

| U.S. Pat. No. | Patentee |
|---|---|
| 618,690 | Ter Laag |
| 1,257,883 | Kone |
| 1,911,973 | Ruse |
| 2,160,836 | Davids |
| 2,184,850 | Schloss |
| 2,188,449 | Stewart |
| 2,290,454 | Steinberg |
| 2,411,610 | Aaron |
| 2,799,878 | Brausch |
| 2,917,759 | Siampaus |
| 3,110,918 | Tate, Jr. |
| 3,214,776 | Bercovitz |
| 3,994,039 | Hadary |
| 4,638,520 | Eickmann |
| 4,682,584 | Pose |
| 4,766,630 | Hegemann |

These patents all disclose devices having different brush stroke action than the desirable rotary action described above, but are of general interest in that they show a wide variety of actuating mechanisms for achieving brush movement.

OBJECTS AND SUMMARY OF THE INVENTION

It is therefore a primary object of the present invention to provide a toothbrush having a built-in mechanism for positively converting reciprocating linear motion of the brush handle to oscillatory rotational movement of the brush relative to the brush head.

It is another object of the present invention to provide a method and apparatus for applying cyclically rotational brush strokes to teeth in response to linear reciprocation of the brush handle, the brush stroke rotation being about an axis oriented perpendicular to the handle reciprocation direction.

It is another object of the present invention to positively convert linear reciprocation of a toothbrush handle to oscillatory rotation of a brush section about an axis oriented perpendicular to the handle without relying on frictional engagement of the rotary brush section bristles with surfaces of the teeth in order to effect the conversion.

In accordance with the present invention, the desired rotary brushing action in a toothbrush is achieved using at least one rotatable brush section and at least one positionally fixed brush section mounted on a toothbrush head so that the bristles face in the same general direction. The rotatable section is positively rotated in response to longitudinal reciprocation of the handle by means of a rack and pinion, or other equivalent mechanism. Importantly, the fixed brush section serves to positionally stabilize the brush head by frictionally engaging the teeth, thereby assuring that the longitudinal reciprocation of the handle is positively converted to cyclically rotation of the rotatable brush section. The bristles of the rotatable brush section are preferably shorter than, or otherwise recessed relative to, the fixed brush section. Consequently, in response to longitudinal forces exerted on the head, the fixed brush bristles flex while frictionally engaging the tooth surfaces as the rotatable section bristles are brought into direct contact with the tooth surfaces to be brushed. In the preferred embodiment, the rotatable brush section is centered longitudinally of the brush head between two fixed brush sections.

BRIEF DESCRIPTION OF THE DRAWINGS

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components, and wherein.

DESCRIPTION OF THE PREFERRED EMBODIMENTS

Figures 1, 2, 3, 4, 5:
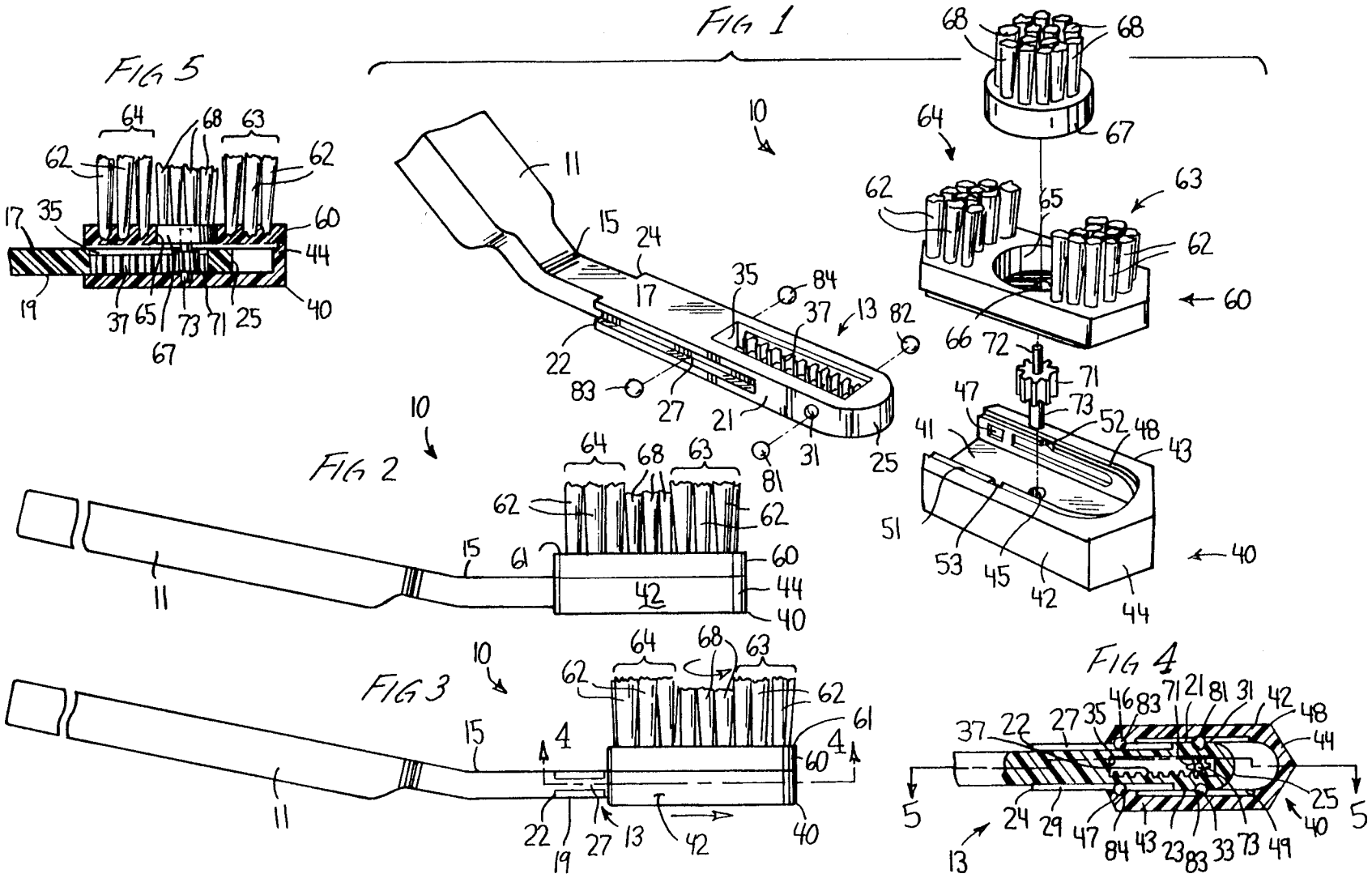
FIG. 1 is an exploded view in perspective of a toothbrush constructed in accordance with the principles of the present invention.
FIG. 2 is a side view in elevation of the toothbrush of FIG. 1 showing the head of the brush in one of its two extreme positions relative to the handle.
FIG. 3 is a side view in elevation of the toothbrush of FIG. 1 showing the head in the opposite extreme position, relative to the handle, from that shown in FIG. 2.
FIG. 4 is a view in section taken along lines 4—4 of FIG. 3.
FIG. 5 is a view in section taken along lines 5—5 of FIG. 4.

Referring to the drawings in greater detail, a toothbrush 10 includes an elongated handle 11 having a proximal end of conventional configuration so as to be held in the hand of a person while being reciprocated longitudinally when the distal end of the brush is disposed in that person's mouth. The handle may have a small bend 15 proximate its distal end as is common for toothbrushes, the bend typically being on the order of ten to twenty degrees. The distal end of the handle constitutes a slide member 13 of generally rectangular transverse cross-section having flat and oppositely facing top and bottom surfaces 17 and 19, respectively, defining the thickness dimension of the slide member. It is to be understood that, for purposes of this description, the word "top" refers to the side of the toothbrush from which the bristles extend, and the word "bottom" is the side of the toothbrush opposite the top side. Slide member 13 has two opposite sidewalls 21, 23 extending longitudinally and defining the width dimension of the slide member. This width dimension is substantially uniform throughout the length of the slide member and is somewhat greater than the width of the handle where the handle joins the slide member at respective shoulders 22, 24. The forward ends of sidewalls 21, 23 are joined by an arcuate front wall 25 having its radius of curvature in a plane parallel to front and rear surfaces 17 and 19.

The side walls 21 and 23 have respective longitudinally coextensive slide channels 27, 29 defined therein and extending along the length dimension of the slide member from its proximal end to a predetermined location short of front wall 25. Slide channels 27, 29 have open ends at shoulders 22, 24 and are longitudinally blocked at their distal ends. Side walls 21 and 23 also have respective recesses 31 and 33 defined therein at locations forward of and slightly spaced from respective channels 27 and 29.

A rectangular cut-out 35 is defined entirely through the thickness dimension of slide member 13. Cut-out 35 is elongated in the longitudinal dimension of slide member 13 and occupies approximately the forward longitudinal half of the slide member. In addition, cut-out 35 occupies most of the width of the slide member. One of the longitudinal walls circumscribing cut-out 35 is provided with a toothed rack 37, the teeth being spaced longitudinally along that entire wall length and converging widthwise of the slide member 13 to occupy between fifteen and thirty percent of the width of the cut-out. Rack 37 may be defined as an integral part of the wall on which it is located, or it may be a separate strip that is adhesively secured to that wall.

The head of toothbrush 10 includes a base 40 and a brush mounting section 60. Base 40 is preferably a single piece of molded plastic having a bottom wall 41 and spaced parallel side walls 42 and 43 extending in height upwardly and along the entire length of the side edges of the bottom wall. A front wall 44 extends upwardly from the forward edge of bottom wall 41 and joins the forward ends of side walls 42 and 43. In the disclosed embodiment, the forward wall 44 and the forward edge of bottom wall 41 are each made up of two converging sections intersecting at an angle on the order of one hundred twenty degrees; however, it will be appreciated that the front wall 44 and forward edge of the bottom wall 41 may also be arcuate. Side walls 42, 43 and front wall 44 define a U-shaped space closed at its bottom by bottom wall 41 but open at its top and its rearward end. Substantially centered in that space, in both length and width, is a bearing recess 45 defined part-way into the thickness of bottom wall 41.

The base side walls 42 and 43 have respective bearing recesses 46 and 47 defined in their interior surfaces at locations intermediate their top and bottom and proximate but spaced from their rearward ends. Recesses 46 and 47 are positioned to be aligned in juxtaposition with respective slide channels 27 and 29 when slide member 13 is inserted into base 40 along bottom wall 41 between side walls 42 and 43. These side walls also have respective base channels 48, 49 defined in their interior surfaces to extend longitudinally from a location forward of respective recesses 46 and 47 to a location proximate the forward ends of the side walls. Base channels 48 and 49 are positioned to be aligned in juxtaposition with respective slide recesses 31 and 33 when slide member 13 is inserted into the base 40 along bottom wall 41 and between side walls 42 and 43.

The very tops of side walls 42 and 43 and front wall 44 are reduced in thickness to define an upwardly facing support ridge 51 extending entirely around the U-shaped interior space in base 40. A pair of semi-cylindrical holes 52, 53 are defined down through support ridge 51 into communication with respective base channels 48, 49. The longitudinal position of holes 52, 53 is generally near the rearward ends of respective tracks 48, 49.

Brush mounting section 60 is a generally solid block of molded plastic material having a lateral periphery corresponding to that of base 40. Accordingly, when mounting section 60 is placed atop base 40, the peripheral walls of the base and mounting section form a continuous peripheral surface. The bottom of mounting section 60 is laterally recessed at its sides, and rearwardly recessed at its forward end, to permit the mounting section bottom to rest on support ridge 51 of base 40 and be restrained against lateral and forward displacements. In addition, cement or other suitable adhesive material secures the bottom of mounting section 60 to ridge 51 and the top portion of side walls 42 and 43.

The top surface 61 of mounting section 60 has two longitudinally spaced fixed clusters 63 and 64 of bristle tufts 62 supported thereon in a conventional manner. Typically, each tuft is mounted in a respective recess or hole in surface 61 and is secured in place by suitable adhesive material. Tuft cluster 63 is disposed proximate the forward end of mounting section 60 whereas tuft cluster 64 is mounted proximate the rearward end of the mounting section. A cylindrical recess 65 is defined in surface 61 at a location intermediate clusters 63 and 64 and substantially centered on surface 61. Centered within recess 65 is a hole defined through the bottom of the recess all the way through to the bottom of mounting section 60. Hole 66 is coaxially aligned with bearing recess 45 in base 40 when the mounting section 60 is properly positioned on base 40.

A rotary brush section includes a cylindrical plate 67 having a radius slightly smaller than the radius of recess 65, whereby plate 67 fits into and is rotatable within that recess. Multiple tufts 68 of bristles are supported on the top surface of plate 67. Tufts 68 are typically arranged in a circular pattern concentrically oriented with respect to the circumference of plate 67. Preferably, fixed tuft clusters 63 and 64 are arranged in arcuate patterns oriented concentrically with respect to the rotatable tufts 68. The fixed bristle tufts 62 extend further from surface 61 than do the bristles in rotatable tufts 68. This may be accomplished either by making the fixed bristles longer than the rotatable bristles, or by recessing the top surface of plate 67 below surface 61.

The rotary brush section also includes a pinion 71 having a circumferential series of teeth and provided with a drive shaft 72 extending coaxially from its top end and a bearing shaft 73 extending coaxially from its bottom end. Drive shaft 72 extends through hole 66 in recess 65 into a suitably provided hole centered in the bottom of plate 67 where the drive shaft is secured by adhesive, or the like, so that plate 67 is caused to rotate with pinion 71. The pinion body is diametrically much larger than hole 66 so that plate 67 is prevented from being pulled out of recess 65. The distal end of bearing shaft 73 is disposed in bearing recess 45 in base 40. The teeth of pinion 71 are disposed within cut-out 35 of slide member 13 so as to interactively engage the teeth of rack 37.

A first pair of ball bearings 81 and 82 are disposed in respective slide member recesses 31 and 33 and extend into respective tracks 48 and 49 of base 40. A second pair of ball bearings for 83 and 84 are disposed in respective base recesses 46 and 47 and extend into respective slide member channels 27 and 29. The purpose of semi-cylindrical holes 52 and 53 is to permit insertion of ball bearings 82 and 81 into respective tracks 48 and 49 during assembly of the toothbrush. Ball bearings 83 and 84 are inserted into tracks 27 and 28, respectively, from the open rearward ends of the tracks. It will be appreciated that, although the ball bearings provide for smooth longitudinally sliding of slide member 13 in base 40, other slide arrangements may be employed. For example, male track members may be provided along the slide member or base to be received in female track members disposed longitudinally of the base or slide member, respectively.

In operation, the head of the toothbrush is inserted into a person's mouth with the exposed tips of the bristles of fixed tufts 62 urged against the person's teeth. Assuming that the brush head is initially fully extended, as illustrated in FIG. 3, the handle is pushed toward the head while the bristles of fixed tufts 62 are urged against the teeth, causing those bristles to slightly flex rearwardly, and permitting the rotatable bristle tufts 68 to contact the tooth surfaces. Frictional engagement between the bristles of fixed tufts 62 against the tooth surfaces minimizes forward movement of the brush head in response to the forward pushing force applied to the handle; instead, slide member 13 slides forwardly in base 40 causing rack 37 to rotate pinion 71. Preferably, the length of rack 37 and the circumference of pinion 71 are chosen to permit approximately one complete rotation of the pinion for each longitudinal excursion of the rack. After slide member 13 reaches the forward end of the recess in base 40, continued forward force applied to handle 11 causes the brush head to move forwardly without rotation of plate 67 and its bristle tufts 68. Instead, all of the bristle tufts 62 and 68 are pushed forwardly across the teeth to effect conventional brushing. When handle 11 is pulled backward in the opposite direction, the bristles of tufts 62 flex forwardly and frictionally engage the teeth to positionally stabilize the head and permit handle slide member 13 to move rearwardly relative to the brush head. The rearward movement of the slide member 13 permits rack 37 to rotate pinion 71 and plate 67 in the opposite direction, whereby the bristles and tufts 68 likewise rotate in the opposite direction. When the forward end of cut-out 35 reaches pinion 71, rotation of plate 67 and its bristle tufts 68 terminates, and continued rearward movement of the brush handle causes the head and all of the bristles to be pulled rearwardly. Continued longitudinal reciprocation of the handle results in oscillatory rotation of the rotatable tufts 68 in the same manner.

If the person using the brush decides to apply the rotary brush action to a particular tooth, the reciprocating longitudinal handle strokes are intentionally limited in length to only that which effects rotation of pinion 71. Typically, this involves forward and backward strokes of approximately one-half inch in length. The point of each stroke at which rotation of pinion 71 terminates is readily sensed or felt by the person since the forward end of slide member 13 impacts against the forward end of the U-shaped channel in base 40, or the forward end of cut-out 35 impacts pinion 71, depending upon the direction of movement. The brush head can be moved from tooth to tooth, on both exterior and interior tooth surfaces, to apply oscillatory rotatable brush action to all of the teeth in the person's mouth. If cross-tooth brush strokes are desired, longer longitudinal strokes may be employed; if up and down strokes are desired, the brush is merely rotated about the handle axis in a conventional manner.

The lengths of the fixed bristles in clusters 63 and 64 need not all be equal. It is particularly advantageous, for example, for the fixed bristles closest to the longitudinal center to be shorter than the fixed bristles closest to the sides of mounting section 60. Such an arrangement makes it easier for the fixed bristles to conform to teeth adjacent the tooth being rotatably brushed, particularly the incisors located at the curvatures in the jaw bone. Typically, the variation in fixed bristle lengths is a gradual taper from the innermost to the outermost bristles, and the maximum length difference is on the order of twenty percent. However, even the shortest fixed bristles are preferably longer than the rotatable bristles, thereby assuring that the fixed bristles frictionally engage tooth surfaces to prevent the brush head from moving longitudinally with the handle and thereby permitting rack 37 to rotatably drive pinion 71.

By way of example only and not to be construed as a limitation on the present invention, a working embodiment of the present invention has been constructed wherein: the length (i.e., front to back) of mounting section 60 is 1 ⅜ inches, its width is 17/32; the exposed portions of the longest of the fixed bristles in clusters 63 and 64 have a length of 7/16 inch while the shortest fixed bristles have exposed lengths of ⅜ inch; the exposed portions of rotary bristles in tufts 68 have a length of 5/16 inch; the diameter of the pattern of rotary bristle tufts 68 is ⅜ inch; the length of each longitudinal stroke of slide member 13 between its limits imposed by cut-out 35 and pinion 71 is one-half inch; and plate 67 rotates slightly more than three hundred sixty degrees for each such longitudinal stroke.

It will be appreciated that the present invention provides a method and apparatus for converting longitudinal reciprocation of a tooth brush handle into oscillatory rotation of bristles about an axis oriented generally perpendicular to the longitudinal motion of the handle, whereby the rotated bristles provide a desired oscillating rotary brushing action for removing built-up deposits on tooth surfaces. This desirable result is achieved without an electrical, mechanical or fluid pressure motor. Importantly, to keep the brush head from moving with the handle during longitudinal reciprocation of the handle, the head is provided with fixed bristle tufts in addition to the rotary bristles. The fixed bristles frictionally engage the tooth surface while the rotary bristles rotate in response to the longitudinal reciprocation of the handle within the stationary brush head.

Having described a preferred embodiment of a new and improved method and apparatus for brushing teeth with cyclically rotating brush strokes according to the present invention, it is believed that other modifications, variations and changes will be suggested to those skilled in the art in view of the teachings set forth herein. Accordingly, it is to be understood that all such variations, modifications and changes are believed to fall within the scope of the present invention as defined by the appended claims.

What I claim is:

1. A toothbrush comprising:

a handle elongated in a longitudinal dimension;

a brush head having a first surface;

a plurality of positionally rotatable brush bristles secured to and extending generally perpendicularly from said first surface;

means securing said handle to said brush head for permitting longitudinal movement of said handle relative to said brush head;

motion conversion means responsive to reciprocating motion of said handle along said longitudinal dimension relative to said brush head for rotating said plurality of rotatable brush bristles about an axis perpendicular to said first surface; and a plurality of positionally fixed brush bristles extending generally perpendicularly from said first surface for engaging tooth surfaces to oppose longitudinal movement of said brush head along with said handle in response to longitudinal reciprocation of said handle.

2. The toothbrush according to claim 1 wherein said plurality of positionally fixed brush bristles are arranged in two spaced clusters disposed on opposite longitudinal sides of said plurality of positionally rotatable brush bristles.

3. The toothbrush according to claim 1 wherein said plurality of positionally rotatable brush bristles are secured to a cylindrical plate rotatably disposed in a cylindrical recess defined in said first surface of said brush head such that the plate is rotatable about its longitudinal axis oriented perpendicular to said first surface.

4. The toothbrush according to claim 3 wherein said means securing said handle to said brush head includes an elongated recess in said brush head for receiving a slide portion of said handle in longitudinally slidable relation, and wherein said motion conversion means comprises:

a toothed pinion disposed in said elongated recess for rotation therein, said pinion having a drive axis secured to said cylindrical plate in coaxial relation with said longitudinal axis of said cylindrical plate such that said cylindrical plate rotates with said pinion; and a toothed rack secured to said slide portion of said handle in interacting relation with said pinion to rotate said pinion as said slide portion moves longitudinally in said elongated recess.

5. The toothbrush according to claim 4 wherein the dimensions of said rack and pinion are such that said plate rotates at least approximately three hundred and sixty degrees for each stroke of said rack past said pinion.

6. The toothbrush according to claim 4 wherein said positionally fixed brush bristles extend in length further from said first surface than do said positionally rotatable bristles.

7. The toothbrush according to claim 6 wherein said plurality of positionally fixed brush bristles are arranged in two spaced clusters disposed on opposite longitudinal sides of said plurality of positionally rotatable brush bristles.

8. The toothbrush according to claim 4 wherein said plurality of positionally fixed brush bristles are arranged in two spaced clusters disposed on opposite longitudinal sides of said plurality of positionally rotatable brush bristles.

9. The method of applying oscillatory rotational brush strokes to teeth in response to longitudinally reciprocating motion of a handle of a toothbrush, said method comprising the steps of:

frictionally engaging tooth surfaces with positionally fixed brush bristles secured in fixed relation to a head of said brush to oppose longitudinal movement of said head due to longitudinal reciprocation of said handle;

longitudinally sliding said handle back and forth within said head in response to longitudinal reciprocation of said handle when said fixed brush bristles frictionally engage said tooth surfaces; and in response to said back and forth sliding of said handle in said brush head, rotating a plurality of rotatable brush bristles secured to said head about an axis oriented generally perpendicular to said sliding motion.

10. The method according to claim 9 wherein each longitudinal slide stroke of said handle within said brush head rotates said rotatable brush bristles through an angle of approximately 360°.

11. The method according to claim 9 wherein the step of frictionally engaging includes engaging said tooth surfaces with two longitudinally spaced clusters of said positionally fixed brush bristles disposed on opposite longitudinal sides of a cluster of said rotatable bristles.

12. A toothbrush comprising:

a handle;

a brush head having a first surface;

a first plurality of tufts of brush bristles fixedly mounted on said first surface;

a generally cylindrical plate mounted on said brush head for rotatability about an axis generally parallel to said bristles in said first plurality of tufts;

a second plurality of tufts of brush bristles mounted on said plate to extend generally parallel to said bristles in said first plurality of tufts;

means for securing said handle to said brush head to permit longitudinal movement of said handle within said brush head; and means response to longitudinal movement of said handle within said brush head for rotating said plate and said second plurality of tufts about said axis without rotating the bristles in said first plurality of tufts.

13. The toothbrush according to claim 12 further comprising:

a third plurality of tufts of brush bristles fixedly mounted on said first surface in parallel relation to the bristles of said first and second pluralities of tufts, wherein said first and third pluralities of tufts are spaced from one another on opposite longitudinal sides of said plate.

14. The toothbrush according to claim 13 wherein said means securing said handle to said brush head includes an elongated recess in said brush head for receiving a slide portion of said handle in longitudinally slidable relation, and wherein said motion conversion means comprises:

a toothed pinion disposed in said elongated recess for rotation therein, said pinion having a drive axis secured to said cylindrical plate in coaxial relation with said longitudinal axis of said cylindrical plate such that said cylindrical plate rotates with said pinion; and a toothed rack secured to said slide portion of said handle in interacting relation with said pinion to rotate said pinion as said slide portion moves longitudinally in said elongated recess.

15. The toothbrush according to claim 14 wherein the dimensions of said rack and pinion are such that said plate rotates at least approximately three hundred and sixty degrees for each stroke of said rack past said pinion.

16. The toothbrush according to claim 15 wherein said positionally fixed brush bristles extend in length further from said first surface than do said positively rotatable bristles.

* * * * *